United States Patent [19]

Ricles

[11] Patent Number: 5,007,486

[45] Date of Patent: Apr. 16, 1991

[54] PERFORATING GUN ASSEMBLY AND UNIVERSAL PERFORATING CHARGE CLIP APPARATUS

[75] Inventor: Thomas D. Ricles, Houston, Tex.

[73] Assignee: Dresser Industries, Inc., Dallas, Tex.

[21] Appl. No.: 473,729

[22] Filed: Feb. 2, 1990

[51] Int. Cl.[5] ..... E21B 43/117

[52] U.S. Cl. ..... 175/4.6; 102/310; 166/55.1

[58] Field of Search ..... 175/4.51, 4.53, 4.54, 175/4.55, 4.56, 4.57, 4.6; 102/310, 320; 166/55, 297, 55.1

[56] References Cited

U.S. PATENT DOCUMENTS

| | | | |
|---|---|---|---|
| 3,036,521 | 5/1962 | Owen | 175/4.6 |
| 3,444,810 | 5/1969 | Hakala | 102/310 |
| 3,739,723 | 6/1973 | Hakala | 102/310 |
| 4,140,188 | 2/1979 | Vann | 175/4.51 |
| 4,519,313 | 5/1985 | Leidel | 102/310 |
| 4,534,423 | 8/1985 | Regalbuto | 175/4.6 |
| 4,541,486 | 9/1985 | Wetzel et al. | 166/297 |
| 4,753,301 | 6/1988 | Berry | 175/4.6 |
| 4,832,134 | 5/1989 | Gill | 175/4.6 |
| 4,889,183 | 12/1989 | Sommers et al. | 102/310 |

*Primary Examiner*—Ramon S. Britts
*Assistant Examiner*—Terry Lee Melius
*Attorney, Agent, or Firm*—Jones, Day, Reavis & Pogue

[57] ABSTRACT

A perforating gun assembly and universal perforating charge clip apparatus in which a universal design of the charge and the charge clip include trapping of the detonating or firing cord, a lock-in position of the charge in both the radial and transverse directions and vertical support of the shaped charge in the gun assembly.

17 Claims, 3 Drawing Sheets

PERFORATING GUN ASSEMBLY AND UNIVERSAL PERFORATING CHARGE CLIP APPARATUS

FIELD OF THE INVENTION

The present invention relates generally to well perforating, such as is practiced in the petroleum industry, and specifically to a perforating gun assembly utilizing a universal perforating charge clip apparatus for holding the charge in the perforating gun in abutting relationship with a firing cord.

BACKGROUND OF THE INVENTION

Shaped charges are well-known in the petroleum industry and are used to perforate a casing and the surrounding producing formations in a bore hole. The shaped charges are required to be attached in some fashion to a charge carrier and held in position while lowered into the bore hole casing and positioned for firing. It is generally well-known that once a particular configuration of charges in a carrier is adapted, the apparatus cannot be changed to accommodate different sized charges or positions of charges for a different or other operation. In such case, if a change is desired, a new carrier must be configured with new shaped charges and a new mounting pattern therein because the old one or previous one cannot be modified. Thus, the earlier devices involved one unique charge with a piece of material, either molded or machined, permanently attached to the charge for positioning and holding the charge in the carrier. This restriction resulted in a design that performed only in its unique geometric parameters, including charge stand off, gun clearance, angularity and vertical spacing of the charges and could not be easily modified to accommodate a different operation.

The present invention overcomes the disadvantages of the prior art by providing a universal adaptation concept involving a charge that is designed around several gun sizes (geometric parameters) and is further complemented with interchangeable adaptors or clips for holding the charge in a charge carrier in proper relationship with both the carrier and a firing cord. This universal adaptation concept obviates the requirement to store the most popular sizes of the shaped charges because the present design can cover all sizes of shaped charges in the inventory. This eliminates the requirement to inventory all different sizes of shaped charges, charge carriers and adaptor or clip assemblies for holding charges in the carrier in proper relationship with a firing cord. The unique universal design of the charge and the charge adaptor or clip includes the trapping of the detonating or firing cord, a lock-in position in both the radial and transverse directions, and the vertical support of the shaped charge. Previous designs either trapped the cord or held the charge so as to prevent its moving in one direction, but never provided both advantages. The present design uses a flat, washer-shaped collar or flange on each shaped charge housing regardless of size. This flat, washer-type collar has a slot or space formed under the collar for mating with the improved adaptor or clip. The clip includes a body portion having a slot at one end thereof for receiving the washer-type collar of the shaped charge to hold the shaped charge in position. A retainer is formed at the other end of the improved clip or adaptor for extending through a port in the housing of the gun carrier assembly for supporting the shaped charge.

In the preferred embodiment of the universal adaptor or clip, the retainer portion of the clip includes a body construction having a U-shaped cavity therein so as to enable the legs of the U to be pressed together for insertion into a port of the gun carrier, the body construction returning to the U-shape after being inserted into the port. The bottom portion of the U-shaped cavity holds the firing cord in an abutting relationship with the shaped charge to allow proper operation thereof.

The charge holding slot in the universal clip is self-locking to securely hold the charge. To enable the clip to be self-locking, the slot has an entry portion having a width slightly less than the diameter of the flat, washer-shaped collar requiring a press fit of the charge body into the entry portion of the clip slot. It also has a charge holding portion in the form of a portion of a circle greater than 180°, the diameter of the circle portion being slightly larger than the diameter of the flat, washer-shaped collar allowing a free fit of the charge body with the holding portion of the clip slot. This construction enables the flat, washer-shaped collar of the shaped charge to be pressure forced through the entry portion of the clip slot into the charge holding portion that is in the form of a portion of a circle. The charge is then securely held in a self-locking relationship and will not be released from the clip through any movement of the charge. However, the charge can be manually forced back out of the mounting clip through the entry portion of the slot if necessary.

With this particular construction, the bottom portion of the U-shaped cavity is positioned inside the gun container for holding the firing cord against the charge.

In an alternate embodiment of the present invention, the retainer portion of the clip extends through a given carrier port and includes an opening therein for receiving the firing cord from the outside of the gun carrier for holding the charge in place for firing. The retainer in the alternate embodiment is press fit in the port of the carrier.

SUMMARY OF THE INVENTION

Thus, the present invention relates to a universal perforating charge clip or adapter apparatus for use in a perforating gun assembly that perforates a casing located down hole in a bore hole. The gun assembly includes a carrier housing and a plurality of first ports formed in the housing through which a jet from a shaped charge can emerge, a firing cord for the shaped charge, the shaped charge having a flat washer-type collar at one end and a space formed under the collar. The improved clip or adapter for holding the charge comprises a body portion, a slot at one end thereof for receiving the flat washer-type collar of the shaped charge to hold the shaped charge, a retainer at the other end for extending through a second port in the housing to support the shaped charge, and a U-shaped opening in the retainer for trapping and positioning the firing cord against the charge for proper firing operation.

The invention also relates to a perforating gun assembly for use in a well bore comprising a cylindrical carrier, a plurality of first ports in the carrier, a like plurality of shaped charges each having one end supported by a corresponding one of the ports, a plurality of second ports in the carrier, each second port being located diametrically opposite a corresponding first port, a like plurality of clips each having a first portion extending through a corresponding second port and a second portion attached to the other end of a corresponding charge for supporting the other end of the charge, an opening in each of the clips, and a firing cord passing through each opening in each clip in sequence for firing the charges.

BRIEF DESCRIPTION OF THE DRAWINGS

These and other objects of the present invention will be more easily and readily understood by one skilled in the art by reference to the following detailed description taken in conjunction with the accompanying drawings in which like numerals represent like elements and in which.

DETAILED DESCRIPTION OF THE DRAWINGS

Figure 1:
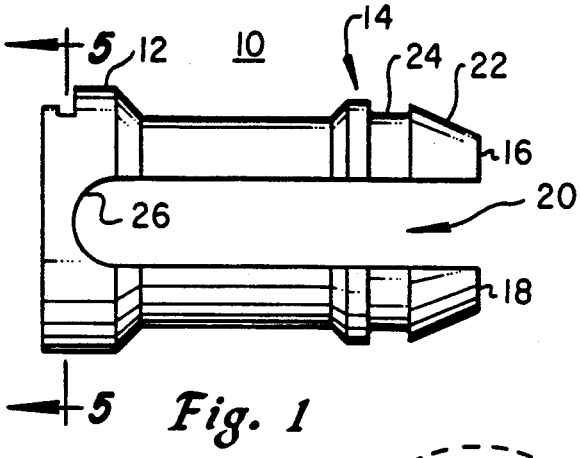
FIG. 1 is a side view of the preferred embodiment of the universal adapter or clip of the present invention.
Figure 2:
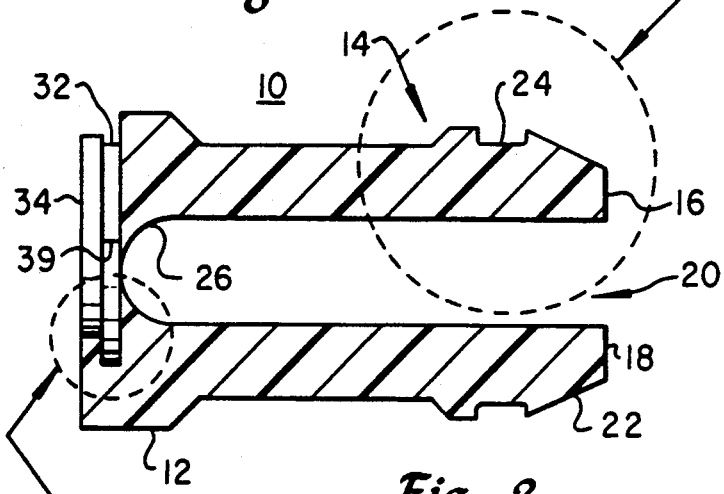
FIG. 2 is a cross-sectional view of the novel clip or adapter shown in FIG. 1 and taken along lines 2—2 of the top view of FIG. 6.

The preferred embodiment of the novel clip or adapter of the present invention is illustrated as a side view in FIG. 1 and is generally designated by the numeral 10. It comprises a body portion 12 having a slot 32 at one end as best shown in FIG. 2, and a retainer portion at the other end including a body construction having a U-shaped cavity 20 therein comprised of legs 16 and 18 separated by the cavity 20. Legs 16 and 18 have tapered shoulders 22 to facilitate the insertion of the retainer end 14 of the clip in an orifice or port of a charge carrier. Each of the legs 16 and 18 also has a recess 24 for locking insertion of the clip in a port of the charged carrier. Thus, as the retainer portion 14 of the clip 10 is inserted in a port, the peripheral edge of the port is received in the groove 24.

Figure 3:
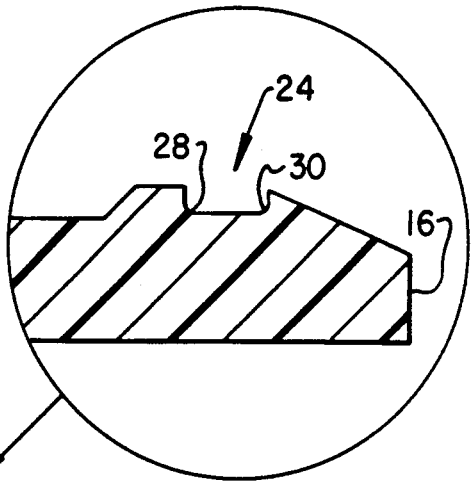
FIG. 3 is an enlarged area of the outer end of the clip of FIG. 1 illustrating the detail thereof.
Figure 6:
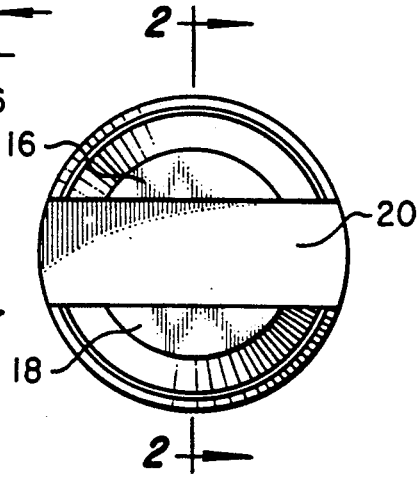
FIG. 6 is a top view of the invention illustrated in FIG. 1.

FIG. 2 is a cross-sectional view of the novel clip or adapter taken along lines 2—2 of FIG. 6, the top view. As can be seen in FIG. 2, the slot 32 is formed in the base 12 creating a shoulder 34. FIG. 3 is an enlarged portion of the outer end of leg 16 of the novel clip 10 illustrating the lock-in area which is in the form of a groove 24 that holds the clip 10 in the charge carrier. It will be noted in FIG. 3 that the corners 28 and 30 of the groove 24 are rounded to reduce stress on the legs 16 and 18 by side thrust loads in either direction forward or backwards that would otherwise disengage the clip from the carrier. Thus, the novel clip 10 radially positions the charge and locks the charge in position in the carrier and prevents the charge from being disengaged from its position by side thrust loads.

Figure 4:
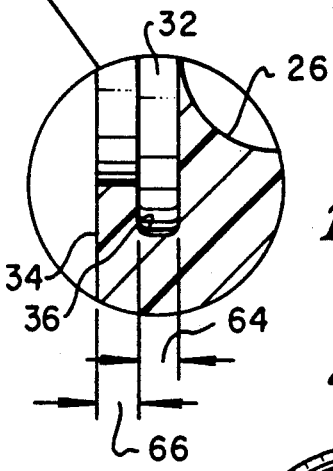
FIG. 4 is an enlarged area of the self-locking slot of the clip of FIG. 2.

The construction of the slot 32 is important and the enlarged area is illustrated in FIG. 4. It will be noted first that the bottom 36 of the slot has a rounded shape. This is important because of the thin layer forming shoulder 34 that is subjected to stress by any movement of the charge. By rounding the corners, specific stress points are eliminated and the outer layer or shoulder 34 is maintained intact rather than broken off because of stresses applied to it. It is also noted in FIG. 4 that the lower portion 26 at the bottom of U-shaped cavity 20 is curved. Again, this construction relieves the stress at the bottom of the slot. It is important that the bottom if the cavity 20 immediately abut slot 32 so that the firing cord when placed in cavity 20 will rest against the charge that is fastened in slot 32 to properly fire the charge. Thus, because the base 26 of cavity 20 is immediately adjacent to slot 32, a thin layer of material is formed and the thin material is subject to stress because the shaped charge is fastened in slot 32. These stresses are relieved by forming the lower portion or base 26 of the cavity 20 in an arcuate shape.

Figure 5:
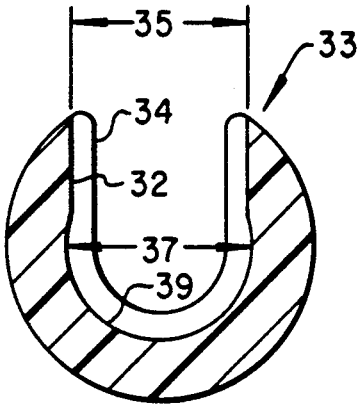
FIG. 5 is a cross-sectional view taken along lines 5—5 of FIG. 1.

FIG. 5 is a cross-sectional view of the lower or body portion 12 of clip 10 taken along lines 5—5 in FIG. 1 to illustrate the construction of the slot for receiving the flat washer-type collar of the shaped charge. It will be noted that the slot 32 is formed under the outer edge 34 to form outer portions 33 that are sufficiently thin to be flexible and allow the flat washer-type collar of the shaped charge to be forced into the slot. The entry portion of the slot has a width 35 that is slightly less than the diameter of the flat washer-type collar of the shaped charge for a press fit. However, the charge holding portion 39 is in the form of a portion of the circle greater than 180° and the diameter 37 of the circle is substantially equal to the diameter of the flat washer-type collar of the shaped charge to securely grip the collar and prevent its inadvertent release so as to form a self-locking charge holding slot.

FIG. 6 is a top view of the novel clip illustrating the legs 16 and 18 separated by the cavity 20.

Figure 7:
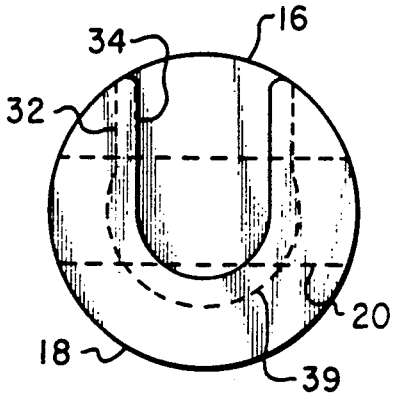
FIG. 7 is a bottom view of the clip shown in FIG. 1.

FIG. 7 is a bottom view of the clip 10 illustrating the legs 16 and 18, the slot 32 having the entry portion of width 35 and the charge holding portion 39 in the form of a portion of a circle greater than 180° having a diameter 37. It will also be noted in FIG. 7 that the charge holding slot 32 is oriented perpendicular to the longitudinal axis of the opening of cavity 20 that traps and positions the firing cord. This is an important feature because, with proper orientation of the clip 10 in relation to the shaped charge, pressures exerted by the firing cord on the clip 10 will be in such a direction as to tend to hold the clip securely on the charge itself.

Thus, the novel clip or adapter 10 illustrated in FIGS. 1–7 has several advantages. It is readily attachable and detachable to the shaped charge to facilitate interchangeability of both the shaped charge and clip. Further, interchangeability of the clip facilitates engineered perforator performance and gun configuration encompassing geometric distribution of perforating charges in the carrier. The clip holds the perforating charge radially aligned with the gun port and provides vertical support for the charge.

The clip 10 is formed of glass-filled nylon to facilitate strength, temperature, and expansion of the interference of the retaining catch 24 on the clip 10. Thus, the universal clip or adapter 10 allows the use of different shaped charge sizes and the cavity 20 in the clip 10 traps the detonating or firing cord within the charge carrier between the wall thereof and the base of the cavity 20. The groove 24 locks the charge in position radially in both directions while also providing vertical support for the shaped charge.

Figure 8:
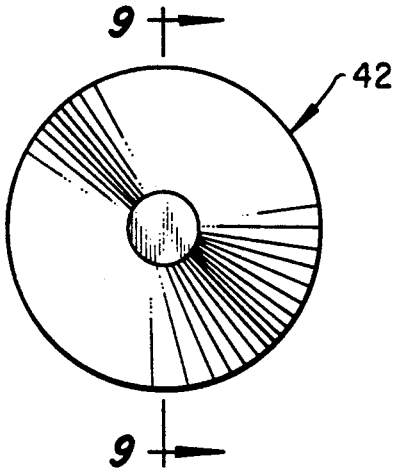
FIG. 8 is a top view of an alternate embodiment of a universal clip or adapter.
Figure 10:
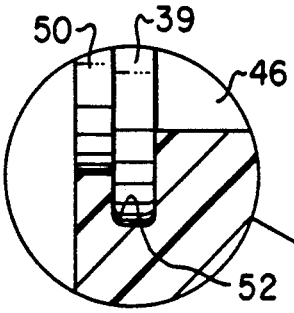
FIG. 10 is an enlarged area of the self-locking slot in the base of the universal adapter or clip illustrated in FIG. 9.
Figure 9:
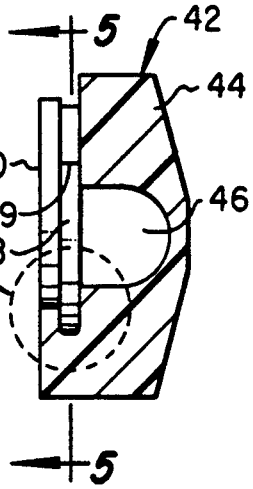
FIG. 9 is a cross-sectional view of the alternate embodiment illustrated in FIG. 8 and taken along lines 9—9.

An alternate version of the clip or adapter is illustrated in FIGS. 8, 9, and 10 wherein the adapter is designated generally by the numeral 42. FIG. 8 is the top view thereof and FIG. 9 is a cross-sectional view taken along lines 9—9 of FIG. 8. As can be seen in FIG. 9, the clip 42 has a body portion 44 in which an aperture 46 is formed for receiving the detonating or firing cord. It also has a slot 48 for receiving the flat washer-type collar of the shaped charge to hold the shaped charge. An outer overlapping layer 50 covers the slot in the manner similar to that illustrated in FIG. 2 for the preferred embodiment of the clip or adapter. The view in FIG. 5 taken along lines 5—5 of FIG. 9, shows that the bottom portion of both the preferred embodiment of FIGS. 1–7 and the alternate embodiment in FIGS. 8–10 have the same type of slot for holding the shaped charge. In both cases, there is an entry portion 32 having a first width 35 slightly less than the diameter of the flat, washer-type collar of the shaped charge for a press fit. A charge holding portion 39 in the form of a portion of a circle greater than 180° has a diameter 37 which is substantially equal to the diameter of the flat, washer-type collar of the shaped charge to secure the charge and prevent its inadvertent release and thus forms a self-locking charge holding slot. FIG. 10 is an enlarged view of a portion of the slot illustrating the charge holding portion 39 and the construction of the bottom of the slot 48 illustrating that the bottom of the slot 48 is arcuate shaped to remove sharp corners and thus relieve stress points on the slot caused by the collar of the shaped charge being positioned there. It will be noted in FIG. 9 that aperture 46 is immediately adjacent slot 48, thus placing the detonating cord immediately against the shaped charge when the shaped charge collar is inserted in slot 48.

Figure 13:
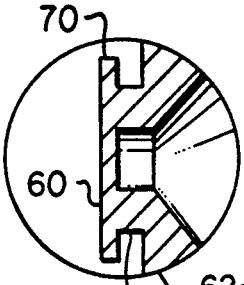
FIG. 13 is an enlarged cross-sectional view of a portion of the top of the shaped charge container illustrated in FIG. 12.
Figure 11:
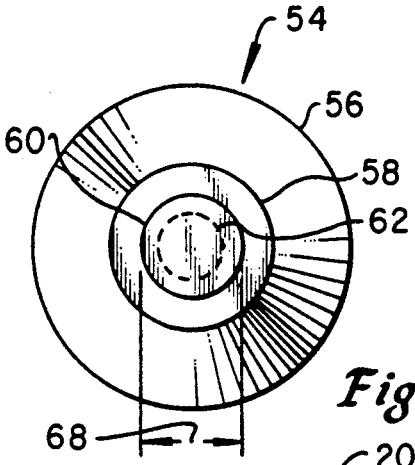
FIG. 11 is a top view of a shaped charge container.
Figure 12:
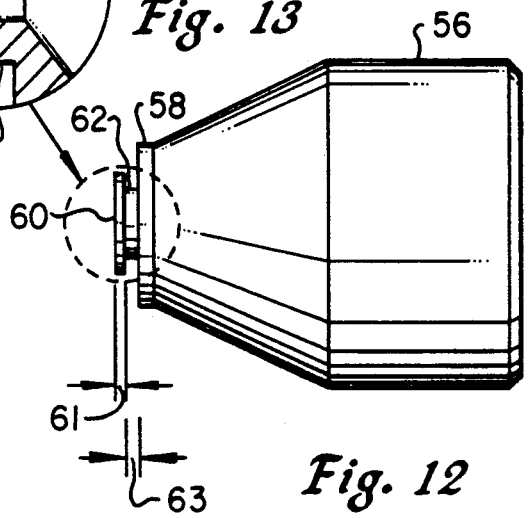
FIG. 12 is a side view of the shaped charge container of FIG. 11.

FIGS. 11, 12 and 13 are top, side and partial cross-sectional views of a shaped charge used with the novel clip or adapters 10 and 54 of the present invention. FIG. 11 is a top view of the shaped charge 54 and illustrates a body portion 56 sloping upwards to shoulder 58. A flat washer-type collar 60 has a slot 62 thereunder and is integrally formed as a part of the shaped charge 54. The thickness 61 of collar 60 in the preferred embodiment is 0.035"and the width of slot 62 is 0.065". Flat washer-type collar 60 fits in slot 32 shown in FIG. 4, or slot 48 shown in FIG. 9, which may have a width 64 of 0.050", thus providing ample clearance. Further, slot 62 of the shaped charge 54 in FIG. 12 has a width 63 of 0.065" while the outer covering 34 in FIG. 4 of clip 10 has a thickness 66 of 0.048". Again, there is ample clearance. The diameter 68 of flat washer-type collar 60 in FIG. 11 is 0.455" while the entry portion 35 of the slot shown in FIG. 5 has a diameter of 0.435", thus requiring a press fit to force the shaped charge into the slot 32. Note, however, that the diameter 37 in the charged holding portion of the slot 32 shown in FIG. 5 has a diameter of 0.460" and thus is 0.005" larger than the diameter 68 of the flat washer-type collar 60. Thus, it will be understood that the shaped charge must be forced into the entry portion of the slot 32 and then has a snug fit in the charge holding portion 39.

As can be seen in FIG. 13, the outer edges 70 of the collar 60 have square corners. This is important to provide a gripping surface between the collar 60 and the slot 39 shown in FIG. 5. Because the shaped charge 54 is formed of metal, the bottom of slot 62 does not have to have curved edges.

Figure 14:
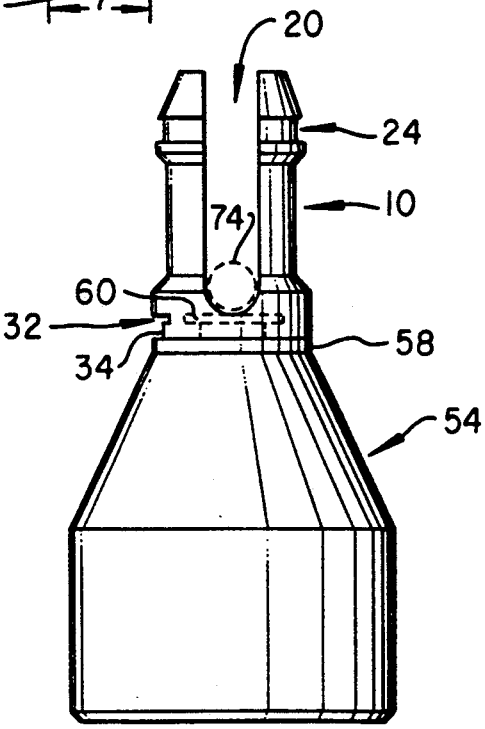
FIG. 14 is a side view of a shaped charge being mounted to the preferred embodiment of the universal clip or adapter.
Figure 15:
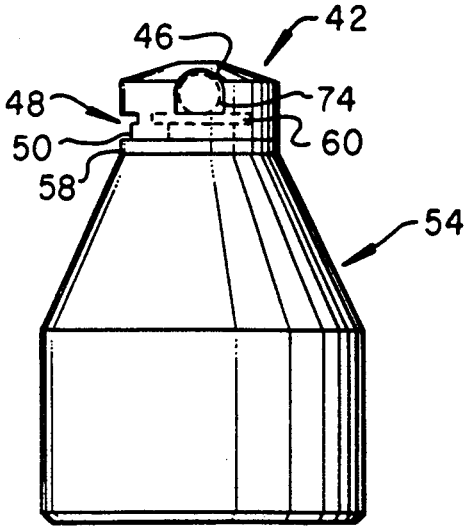
FIG. 15 is a side view of a shaped charge being attached to the alternate embodiment of the novel universal clip or adapter.

FIG. 14 illustrates a side view of a shaped charge 54 attached to and mounted on the clip or adapter 10. It can be seen in FIG. 14 that the flat, washer-type collar 60 of shaped charge 54 is inserted in the slot 32 and is supported in the slot 32 by the outer layer 34 of the clip 10. In like manner, in FIG. 15 the alternate version of the clip 42 is illustrated attached to the shaped charge 54. Again, it would be seen that shoulder 58 of shaped charge 54 rests against the base or outer portion 50 of clip 42 with the flat, washer-type collar 60 of the shaped charge 54 held in place in slot 48. A detonator or firing cord 74 is illustrated in dashed lines in opening 46 held in place against the flat-washer, type collar 60 of shaped charge 54.

Figure 16:
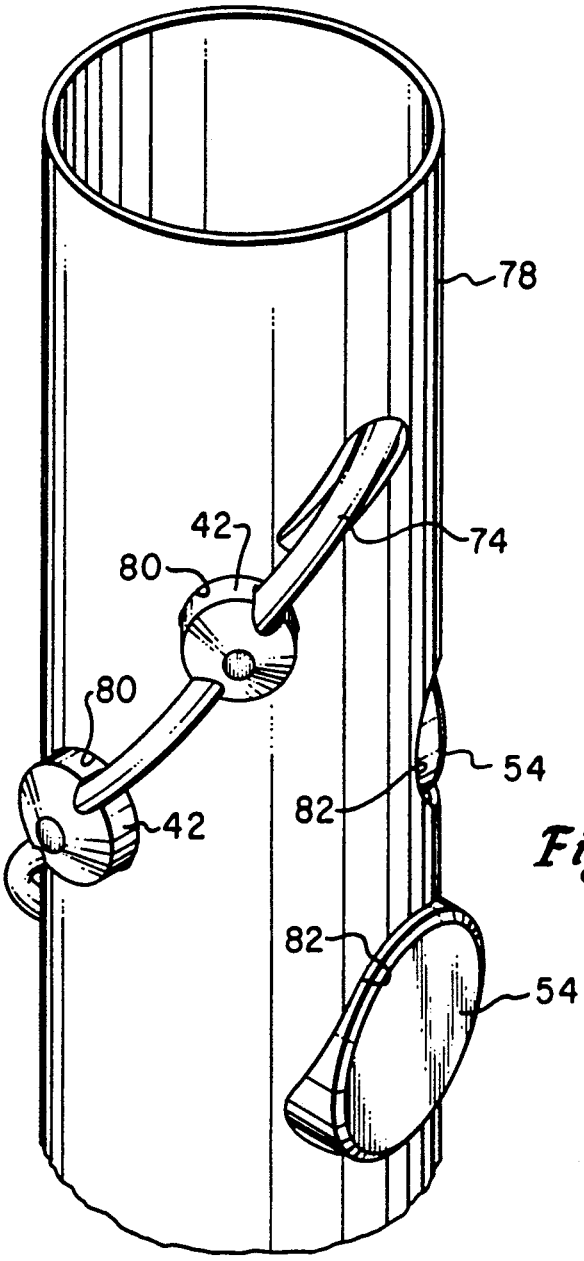
FIG. 16 is an isometric view of the perforating charge carrier assembly illustrating the mounting of the shaped charges utilizing the alternate type of adapter or clip wherein the firing cord is held in position on the outside of the charge carrier.

The use of the two versions of the clips 10 and 42 in a shaped charge carrier is illustrated in connection with FIGS. 16 and 17. In FIG. 16, a charge carrier 78 is shown to be in cylindrical shape and has in it a plurality of first orifices or ports 80, a like plurality of shaped charges 54 each having one end attached to a clip 42 which extends through orifice 80 and supports the shaped charge 54. The other end of the shaped charge 54 extends into a port 82 and is supported therein. A firing cord or detonator cord 74 extends through openings 46 in each of the clips 80 on the outside of the charge carrier 78. The ports 80 and 82 may be arranged in any desired patterns about the carrier 78 to support the shaped charges 54.

Figure 17:
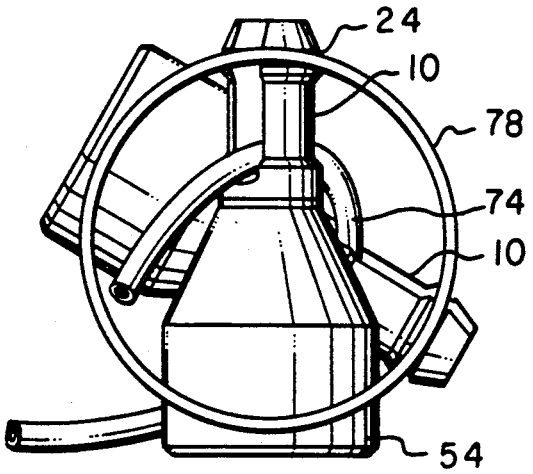
FIG. 17 is a top view of the charge carrier of the perforating gun assembly illustrating the mounting of the shaped charges utilizing the universal clip or adapter of the preferred embodiment of the present invention.

FIG. 17 is a top view of a charge carrier 78 illustrating a shaped charge 54 attached to the preferred embodiment of the clip or adapter 10 which has its outer end extending through a port 80 such as that shown in FIG. 16 and is supported by the channel or groove 24. Thus, the large end of the shaped charge 54 is supported in a large orifice in carrier 78 corresponding to the opening 82 in FIG. 16 while the clip 10 extends through a small orifice in carrier 78 corresponding to orifice 80 in FIG. 16. Again, it will be seen that the firing or detonating cord 74 passes through the cavity 20 in each of the clips 10 and is trapped therein between the casing of the carrier 78 and the base of the opening 20. The cord in FIG. 17 is positioned inside the carrier 78 rather than on the outside.

Thus, there has been disclosed a novel clip or adapter which is readily attachable and detachable to a shaped charge each of which have a common collar or attachment to the adapters. The adapters are interchangeable from one model to another to enable different configurations of the shaped charges within the charge carriers. Interchangeability of the clips or adapters facilitates engineered perforator performance and gun configuration encompassing geometric distribution of perforating charges. The clips or adapters hold the shaped charges in radial alignment with the ports of the charged carrier and vertically support each charge. The clips are configured so as to radially position and lock each shaped charge in place to prevent side thrust loads that could otherwise disengage the shaped charge. The clips trap and position the detonating cord across the shaped charge for proper operation. Further, with the use of the novel clips, the perforating charges are engaged and locked in a geometric distribution that disallows "charge interference" which is the phenomenon that occurs when the detonation wave of the charge is in too close proximity to the adjacent charge; therefore, the detonation pressure wave collides with the detonation and jet forming process of the adjacent perforating charge. The present invention avoids the earlier devices that involve one unique charge with a piece, either molded or machined, permanently attached to the charge. This restriction results in a design that performs only in its unique geometric parameters, charge stand off, gun clearance, angularity and vertical spacing of the charges. The novel adapters or clips can be used with various sized shaped charges in various charge carrier sizes. The novel clips trap the detonating cord, radially lock in the charge in its position in the charge carrier and provide vertical support for the charge. The flexible extended legs of the adapter can be compressed to allow the adapter to be inserted within the port in the carrier and then the legs return to their normal position to lock the charge in place.

While the invention has been shown and described with respect to a particular embodiment thereof, this is for the purpose of illustration rather than limitation; and other variations and modifications of the specific embodiment herein shown and described would be apparent to those skilled in the art all within the intended spirit and scope of the invention. Accordingly, the patent is not to be limited in scope and effect to the specific embodiments shown and described nor in any other way that is inconsistent with the extent to which the progress in the art has been advanced by the invention.

What is claimed is:

1. In a perforating gun assembly for use in perforating a casing located down hole in a bore hole, said gun assembly including a cylindrical carrier housing, and a plurality of first ports formed in the housing through which a jet from a shaped charge can emerge, a firing cord for the shaped charge, the shaped charge having a flat washer-type collar at one end, and a plurality of second ports formed in the housing, an improved clip for holding the charge comprising:

a body portion;

a slot therein for receiving the flat washer-type collar of the shaped charge to hold the shaped charge;

a retainer on the body portion for extending through a said second port in the housing a support the shaped charge; and an opening in the retainer for trapping and positioning the firing cord against the charge for proper firing operation.

2. The improved clip of claim 1 wherein the charge holding slot is oriented perpendicular to the longitudinal axis of the retainer opening for trapping and positioning the firing cord.

3. The improved clip of claim 2 wherein the charge holding slot includes:

an entry position having a first width slightly less than the diameter of the flat, washer-type collar of the shaped charge for a press fit; and a charge holding portion in the form of a portion of a circle greater than 180°, the diameter of the circular portion being substantially equal to the diameter of the flat, washer-type collar to securely grip the charge and prevent its inadvertent release so as to form a self-locking charge holding slot.

4. The improved clip as in claim 3 further including rounded corners on the bottom of the self-locking slot to reduce the possibility of damage to the slot due to stress applied to the corners by the shaped charge.

5. The improved clip of claim 1 wherein the retainer further includes a body construction having a U-shaped cavity so as to enable the legs of the U-shaped cavity to be pressed together for insertion into a said second port of said carrier, said cavity returning to the U-shape after being inserted into said port for locking the retainer in the port.

6. The improved clip of claim 5 wherein the base of the U-shaped cavity positions the firing cord in abutting relationship with the shaped charge to allow proper operation thereof.

7. The improved clip of claim 6 wherein the base of the U-shaped cavity is rounded to resist any stress applied to the cavity.

8. The improved clip of claim 7 having a groove on the outer periphery of the top portion of the legs of the U-shaped cavity for locking insertion of the clip in a said second port of the charged carrier.

9. The improved clip of claim 8 wherein the base of the U-shaped cavity of the clip is positioned inside the container for positioning the firing cord against the charge.

10. The improved clip of claim 1 wherein the retainer further includes an aperture therein for receiving the firing cord on the outside of the carrier for holding the charge in place for firing.

11. The improved clip of claim 10 wherein the retainer is press fit in the port of the charge carrier.

12. The improved clip of claim 10 wherein the aperture of the retainer is substantially cylindrical in shape to resist stress that could be applied to a corner.

13. A perforating gun assembly for use in the well bore comprising:

a cylindrical carrier;

a plurality of first ports in said carrier;

a like plurality of shaped charges each having one end supported by a corresponding one of said first ports;

a plurality of second ports in the carriers, each second port being located diametrically opposite a corresponding first port;

a like plurality of shaped charge support clips each having a portion extending through a corresponding second port and attached to the other end of a corresponding charge for supporting the other end of said charge;

an opening in each of said clips; and a firing cord passing through each clip opening in sequence for firing said charges.

14. A perforating gun assembly as in claim 13 wherein each of the said clips comprises:

a base portion at one end for attachment to a shaped charge; and a body portion at the other end having a U-shaped cavity with parallel legs for insertion in said second port by compressing the parallel legs of the U-shaped cavity.

15. A perforating gun assembly as in claim 14 further comprising:

a flat washer-type collar on said other end of each shaped charge; and a slot in the clip base portion for receiving the flat washer-type collar to support the shaped charge.

16. A perforating gun assembly as in claim 15 further including:

a firing cord; and means in each clip for receiving the firing cord in an abutting relationship with the shaped charge to enable proper firing thereof.

17. A perforating gun assembly as in claim 16 wherein the means for receiving the firing cord is located on the inside of the container.

* * * * *